US008242964B2

(12) United States Patent
Nishi et al.

(10) Patent No.: US 8,242,964 B2
(45) Date of Patent: Aug. 14, 2012

(54) HELICAL ANTENNA AND IN-VEHICLE ANTENNA INCLUDING THE HELICAL ANTENNA

(75) Inventors: Takafumi Nishi, Okazaki (JP); Akira Takaoka, Okazaki (JP); Shiro Koide, Kariya (JP); Ichiro Shigetomi, Nagoya (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 318 days.

(21) Appl. No.: 12/655,814

(22) Filed: Jan. 7, 2010

(65) Prior Publication Data

US 2010/0182209 A1 Jul. 22, 2010

(30) Foreign Application Priority Data

Jan. 16, 2009 (JP) ..... 2009-007545
Aug. 3, 2009 (JP) ..... 2009-180580

(51) Int. Cl.
*H01Q 1/32* (2006.01)

(52) U.S. Cl. ..... 343/711

(58) Field of Classification Search ..... 343/702, 343/711–713, 895
See application file for complete search history.

(56) References Cited

U.S. PATENT DOCUMENTS 6,297,780 B1 10/2001 Kirisawa
6,919,859 B2 * 7/2005 McCarthy et al. ..... 343/895
2005/0052336 A1 * 3/2005 McCarthy et al. ..... 343/895
2007/0216584 A1 * 9/2007 Nishikido et al. ..... 343/702
2008/0174501 A1 * 7/2008 Licul et al. ..... 343/703
2009/0315792 A1 * 12/2009 Miyashita et al. ..... 343/742

FOREIGN PATENT DOCUMENTS

| | | |
|---|---|---|
| JP | 06-164232 | 6/1994 |
| JP | 07-288417 | 10/1995 |
| JP | 08-078946 | 3/1996 |
| JP | 11-261326 | 9/1999 |
| JP | 11-308160 | 11/1999 |
| JP | 2001-016031 | 1/2001 |
| JP | 2007-013318 | 1/2007 |

OTHER PUBLICATIONS

Office Action dated Nov. 16, 2010 from the JPO in the corresponding Japanese Patent Appl. No. 2009-180580 with English translation.

* cited by examiner

*Primary Examiner* — Huedung Mancuso
(74) *Attorney, Agent, or Firm* — Harness, Dickey & Pierce, PLC

(57) ABSTRACT

A helical antenna includes a ground plate, a first helical portion spirally wound perpendicular to the plate, a second helical portion spirally wound perpendicular to the plate and surrounding the first helical portion radially outward of the first helical portion, and a feeder circuit. The circuit includes an oscillator, a divider connected to the oscillator, a first phase shifter connected between a first output terminal of the divider and a feeding point of the first helical portion, and a second phase shifter connected between a second output terminal of the divider and a feeding point of the second helical portion. Length of one turn of the first helical portion is equal to a result of multiplication of a wavelength of oscillation of the oscillator by N. Length of one turn of the second helical portion is equal to a result of multiplication of the wavelength by M (M>N).

7 Claims, 12 Drawing Sheets

@Theta=30°

| LINE TYPE | INTENSITY RATIO 1-WAVELENGTH : 2-WAVELENGTH | PHASE DIFFERENCE (deg) 2-WAVELENGTH — 1-WAVELENGTH |
|---|---|---|
| ——— | 1 : 1 | 0 |
| ····· | 1 : 1 | 90 |
| ——— | 1 : 1 | 180 |
| - - - - - | 1 : 1 | 270 |

@Phi=90°

| LINE TYPE | INTENSITY RATIO 1-WAVELENGTH : 2-WAVELENGTH | PHASE DIFFERENCE (deg) 2-WAVELENGTH — 1-WAVELENGTH |
|---|---|---|
| ——— | 1 : 1 | 270 |
| ····· | 7 : 3 | 270 |
| — — — | 8 : 2 | 270 |
| - - - - - | 1 : 0 | 270 |

FIG. 7A

WIRE MATERIAL HEIGHT 0.1λ

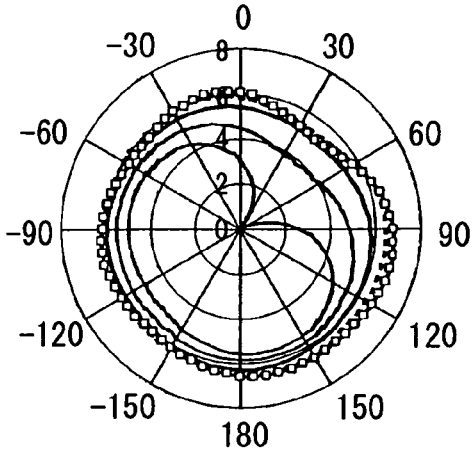

- NUMBER OF TURNS : 1
- NUMBER OF TURNS : 2
- NUMBER OF TURNS : 3
- NUMBER OF TURNS : 4
- NUMBER OF TURNS : 5

FIG. 7B

WIRE MATERIAL HEIGHT 0.2λ

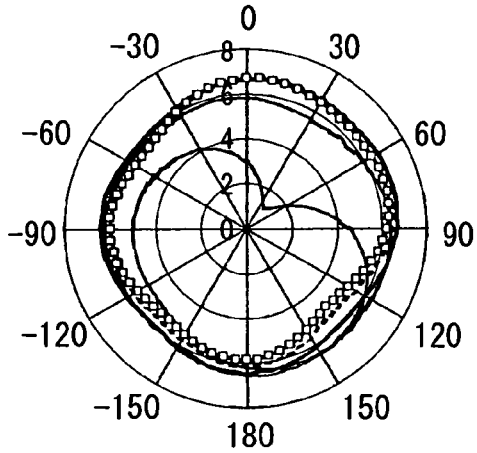

- NUMBER OF TURNS : 1
- NUMBER OF TURNS : 2
- NUMBER OF TURNS : 3
- NUMBER OF TURNS : 4
- NUMBER OF TURNS : 5

FIG. 7C

WIRE MATERIAL HEIGHT 0.3λ

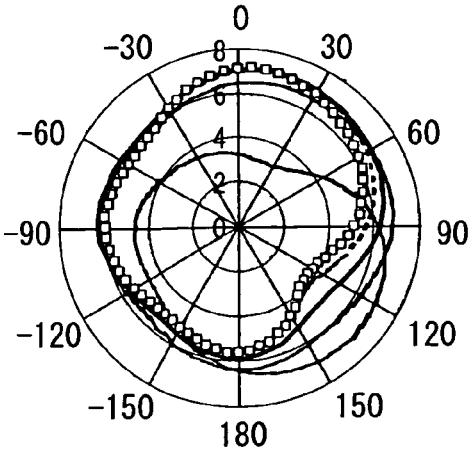

- NUMBER OF TURNS : 1
- NUMBER OF TURNS : 2
- NUMBER OF TURNS : 3
- NUMBER OF TURNS : 4
- NUMBER OF TURNS : 5

FIG. 7D

WIRE MATERIAL HEIGHT 0.4λ

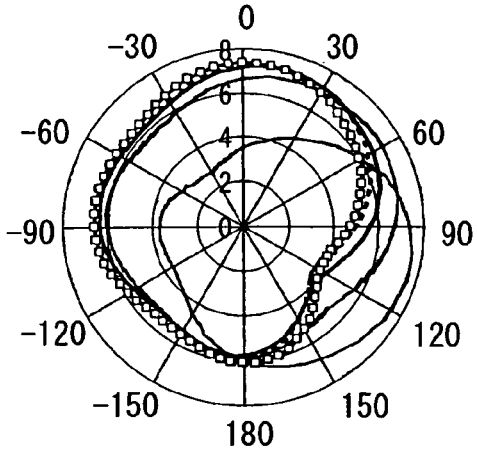

- NUMBER OF TURNS : 1
- NUMBER OF TURNS : 2
- NUMBER OF TURNS : 3
- NUMBER OF TURNS : 4
- NUMBER OF TURNS : 5

HELICAL ANTENNA AND IN-VEHICLE ANTENNA INCLUDING THE HELICAL ANTENNA

CROSS REFERENCE TO RELATED APPLICATION

This application is based on and incorporates herein by reference Japanese Patent Application No. 2009-7545 filed on Jan. 16, 2009 and Japanese Patent Application No. 2009-180580 filed on Aug. 3, 2009.

BACKGROUND OF THE INVENTION

1. Field of the Invention

The present invention relates to a helical antenna and an in-vehicle antenna including the helical antenna.

2. Description of Related Art

Conventionally, a helical antenna is widely-used as a linear antenna having good circular polarization characteristics. When such a helical antenna is used on its own, it is difficult to control directivity of an antenna beam. Accordingly, in a publication of JP-A-8-78946, an array structure is employed, in which helical antennas that form beams having an identical shape are arranged on a planar ground plane, in order to control directivity of a helical antenna whose one turn corresponds to one wavelength (i.e., one turn of the helical antenna measures one wavelength in circumferential length). In JP-A-8-78946, the directivity is controlled by making the beams formed by the helical antennas having the array structure interfere with each other.

However, in the case of the antenna having an array structure as in JP-A-8-78946, the helical antennas need to be arranged at intervals of a half of a wavelength $\lambda$, i.e., $\lambda/2$ in order to control the directivity with the shape of the antenna beam maintained. As a result, the helical antennas at least need to be arranged at intervals of $\lambda/2$, so that there is a limit to downsizing of the entire helical antenna.

SUMMARY OF THE INVENTION

The present invention addresses at least one of the above disadvantages. According to the present invention, there is provided a helical antenna including a ground plate, a first helical portion, a second helical portion, and a feeder circuit. The first helical portion is wound in a spiral manner generally perpendicular to a plane of the ground plate. The second helical portion is wound in a spiral manner generally perpendicular to the plane of the ground plate and surrounds the first helical portion on a radially outer side of the first helical portion. The feeder circuit includes an oscillator, a divider, a first phase shifter, and a second phase shifter. The divider is connected to the oscillator. The first phase shifter is connected between a first output terminal of the divider and a feeding point of the first helical portion. The second phase shifter is connected between a second output terminal of the divider and a feeding point of the second helical portion. A length of one turn of the first helical portion is equal to a result of multiplication of a wavelength of oscillation of the oscillator by a first predetermined number. A length of one turn of the second helical portion is equal to a result of multiplication of the wavelength by a second predetermined number. The second predetermined number is larger than the first predetermined number.

According to the present invention, there is also provided an in-vehicle antenna including the helical antenna.

BRIEF DESCRIPTION OF THE DRAWINGS

The invention, together with additional objectives, features and advantages thereof, will be best understood from the following description, the appended claims and the accompanying drawings in which:

FIG. 7A is a diagram illustrating directivity of gain in a direction $\phi$ provided that height of the second helical portion is $0.1\lambda$, and that the number of turns of the second helical portion is changed to one, two, three, four, or five in accordance with the embodiment;

FIG. 7B is a diagram illustrating the directivity of gain in the direction $\phi$ when the height of the second helical portion is $0.2\lambda$ and the number of turns of the second helical portion is changed between one and five in accordance with the embodiment;

FIG. 7C is a diagram illustrating the directivity of gain in the direction $\phi$ when the height of the second helical portion is $0.3\lambda$ and the number of turns of the second helical portion is changed between one and five in accordance with the embodiment;

FIG. 7D is a diagram illustrating the directivity of gain in the direction $\phi$ when the height of the second helical portion is $0.4\lambda$ and the number of turns of the second helical portion is changed between one and five in accordance with the embodiment;

DETAILED DESCRIPTION OF THE INVENTION

Figure 1:
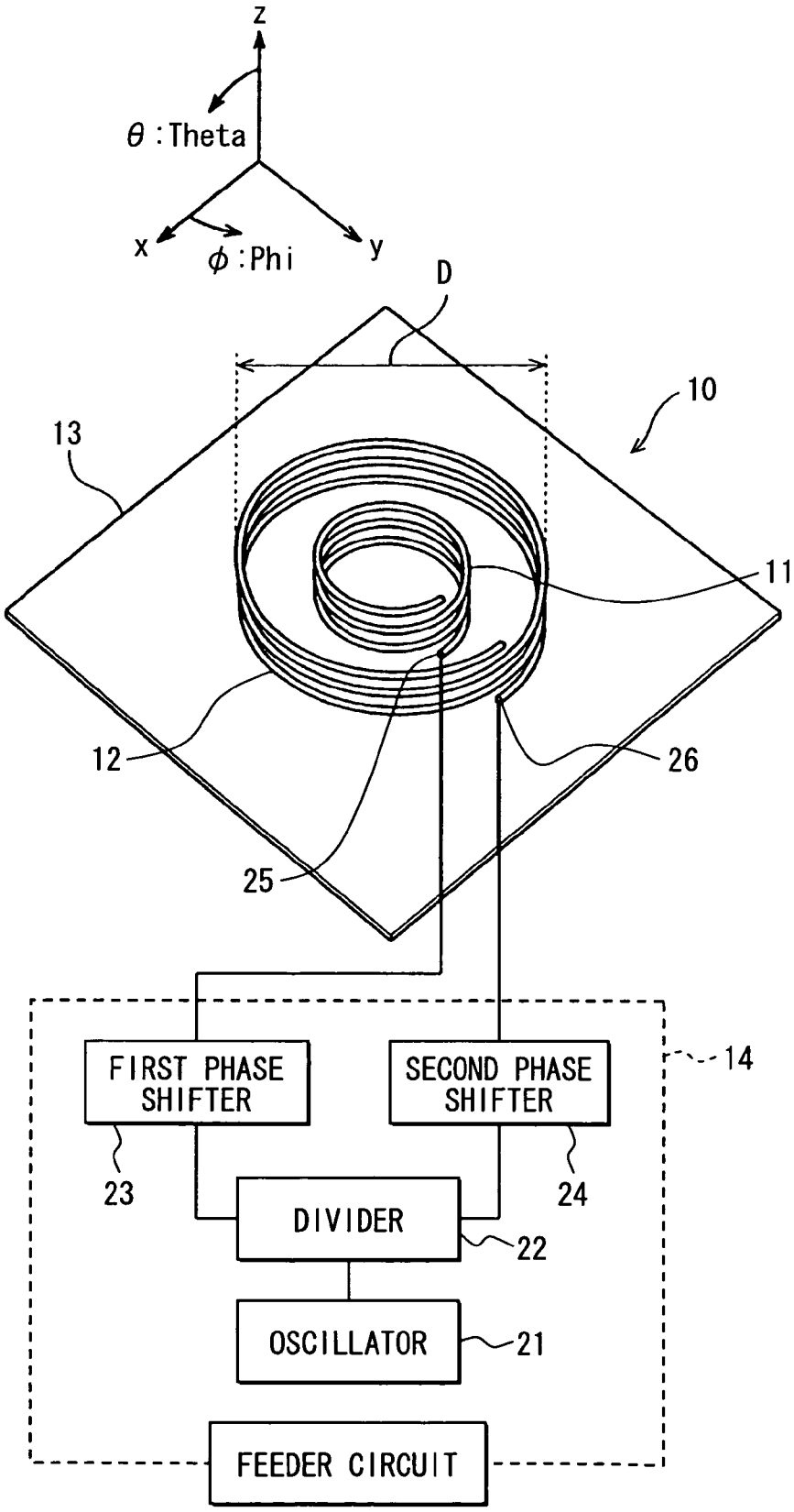
FIG. 1 is a perspective view illustrating a helical antenna in accordance with an embodiment of the invention.

A helical antenna according to an embodiment of the invention, and an in-vehicle antenna, to which the helical antenna is applied, will be described below with reference to the accompanying drawings. The helical antenna will be described below with reference to FIGS. 1 to 5B, and 15. As shown in FIG. 1, a helical antenna 10 according to the embodiment of the invention includes a first helical portion 11, a second helical portion 12, a ground plate (ground plane) 13 and a feeder circuit 14. The ground plate 13 is formed in a plate-like manner from a conductor such as metal. The first helical portion 11 is wound upward in a helical fashion generally perpendicular to the ground plate 13. The first helical portion 11 is wound upward with its one turn corresponding to N-wavelength (i.e., one turn of the helical portion 11 measures N-wavelength in circumferential length). N-wavelength is a result of multiplication of wavelength by N. The second helical portion 12 is, similar to the first helical portion 11, wound upward in a helical fashion generally perpendicular to the ground plate 13. The second helical portion 12 surrounds the first helical portion 11 radially outward thereof, and is wound upward with its one turn corresponding to M-wavelength (i.e., one turn of the helical portion 12 measures M-wavelength in circumferential length). M-wavelength is a result of multiplication of wavelength by M. Because the second helical portion 12 surrounds the first helical portion 11 radially outward thereof, a relationship between N-wavelength of the first helical portion 11 and M-wavelength of the second helical portion 12 is expressed as M>N. In the case of the present embodiment, the first helical portion 11 is configured such that its one turn corresponds to one wavelength, and the second helical portion 12 is configured such that its one turn corresponds to two wavelengths. The first helical portion 11 and the second helical portion 12 are arranged in a generally concentric circle shape. In FIG. 1, longitudinal and transverse directions of the ground plate 13 are referred to as a direction X and a direction Y, and a thickness direction of the ground plate 13 is referred to as a direction Z. A rotational direction with Z-axis serving as a center of the rotation is referred to as a direction $\phi$ (Phi), and a rotational direction with Y-axis serving as a center of the rotation is referred to as a direction $\theta$ (Theta).

The feeder circuit 14 is configured as an electric circuit, and includes an oscillator 21, a divider 22, a first phase shifter 23 and a second phase shifter 24. The oscillator 21 oscillates high-frequency electric power which is supplied to the first helical portion 11 and the second helical portion 12. The divider 22 is a Wilkinson divider. The divider 22 is connected to an output side of the oscillator 21 and distributes a high-frequency wave, which is oscillated by the oscillator 21, to the first helical portion 11 and the second helical portion 12. The first phase shifter 23 is connected to an output side of the divider 22, and electrically connected to a feeding point 25 of the first helical portion 11. Likewise, the second phase shifter 24 is connected to the output side of the divider 22, and electrically connected to a feeding point 26 of the second helical portion 12.

Figure 2:
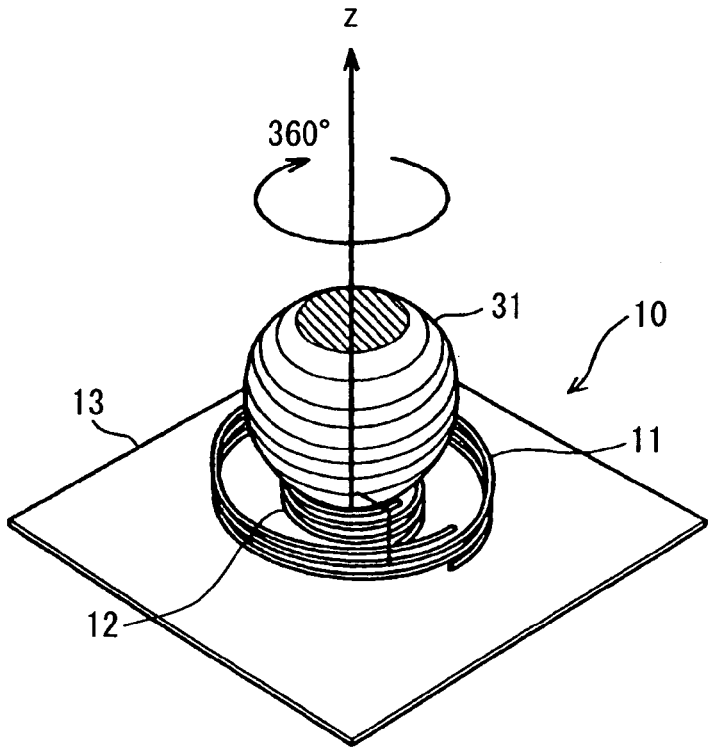
FIG. 2 is a diagram illustrating an antenna beam emitted from a first helical portion of the helical antenna in accordance with the embodiment.

As illustrated in FIG. 2, a maximum gain direction of an antenna beam 31 emitted from the first helical portion 11, whose one turn corresponds to one wavelength, is a direction of Z-axis which is perpendicular to the ground plate 13. Accordingly, the antenna beam 31 emitted from the first helical portion 11 has large gain in a hatched area in FIG. 2. A phase of the antenna beam 31 emitted from the first helical portion 11 differs by 360 degrees for one revolution in the direction $\phi$.

Figure 3:
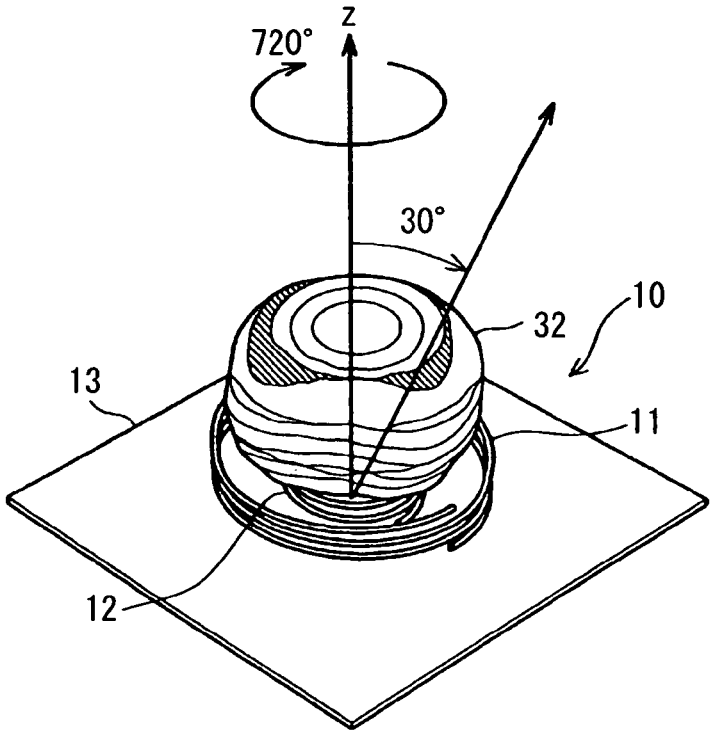
FIG. 3 is a diagram illustrating an antenna beam emitted from a second helical portion of the helical antenna in accordance with the embodiment.

On the other hand, as illustrated in FIG. 3, a maximum gain direction of an antenna beam 32 emitted from the second helical portion 12, whose one turn corresponds to two wavelengths, is $\theta$=30 degrees in the direction $\theta$, and is constant in the direction $\phi$. Accordingly, the antenna beam 32 emitted from the second helical portion 12 has large gain in a hatched area in FIG. 3. A phase of the antenna beam 32 emitted from the second helical portion 12 differs by 720 degrees for one revolution in the direction $\phi$.

Figures 4A, 4B:
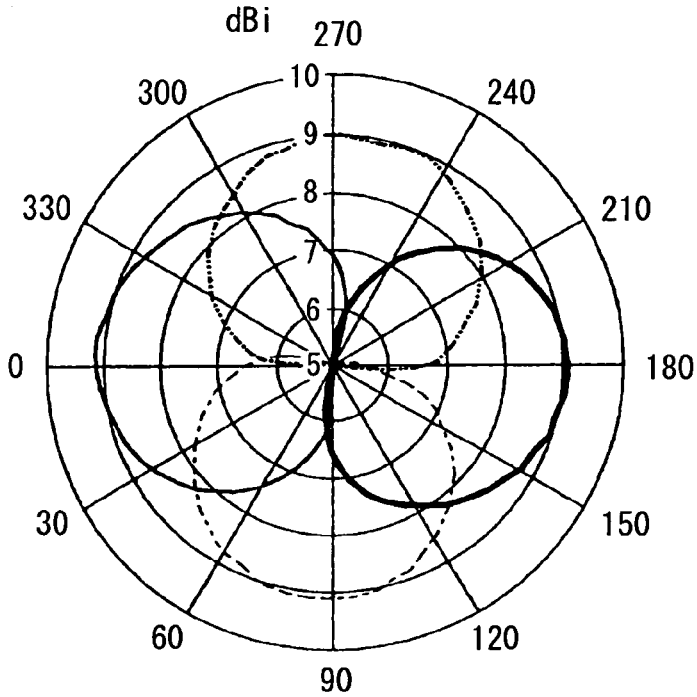
FIG. 4A is a diagram illustrating directivity of a main beam of the helical antenna in accordance with the embodiment.
FIG. 4B is a table showing a phase difference of high-frequency electric powers supplied to the first helical portion and the second helical portion at $\theta=30$ degrees in accordance with the embodiment.
Figures 5A, 5B:
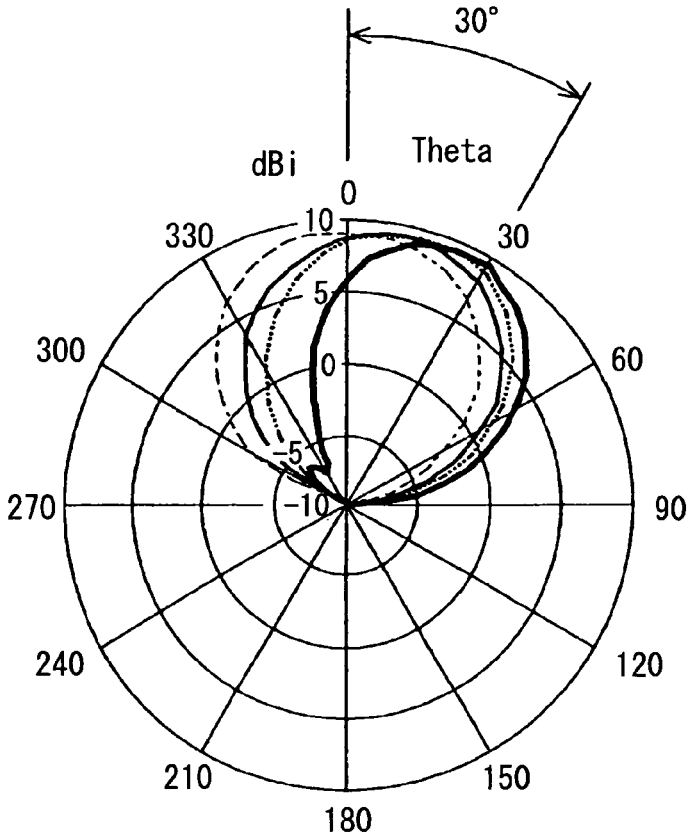
FIG. 5A is a diagram illustrating the directivity of the main beam of the helical antenna in accordance with the embodiment.
FIG. 5B is a table showing an intensity ratio of the high-frequency electric powers supplied to the first helical portion and the second helical portion at $\phi=90$ degrees in accordance with the embodiment.

In the above-described configuration, by changing a phase difference between a phase of the high-frequency wave supplied to the first helical portion 11 from the first phase shifter 23 of the feeder circuit 14, and a phase of the high-frequency wave supplied to the second helical portion 12 from the second phase shifter 24, a direction of a main beam produced by interaction between the antenna beam emitted from the first helical portion 11 and the antenna beam emitted from the second helical portion 12 is controlled in a range of 360 degrees in the direction $\phi$, as illustrated in FIGS. 4A and 4B. In other words, directivity of the main beam in the direction $\phi$ is controlled in a range of 360 degrees. By changing an intensity ratio between intensity of high-frequency power fed to the first helical portion 11 and intensity of high-frequency power fed to the second helical portion 12, through the divider 22 of the feeder circuit, 14, a direction of the main beam is controlled in a range of 0 to 30 degrees in the direction $\theta$, as illustrated in FIGS. 5A and 5B. In other words, directivity of the main beam in the direction $\theta$ is controlled in a range of 0 to 30 degrees. Accordingly, the directivities of the main beam in the direction $\phi$ and the direction $\theta$ are controlled by the phase and intensity of the high-frequency wave supplied to the first helical portion 11 and the second helical portion 12.

Figure 15:
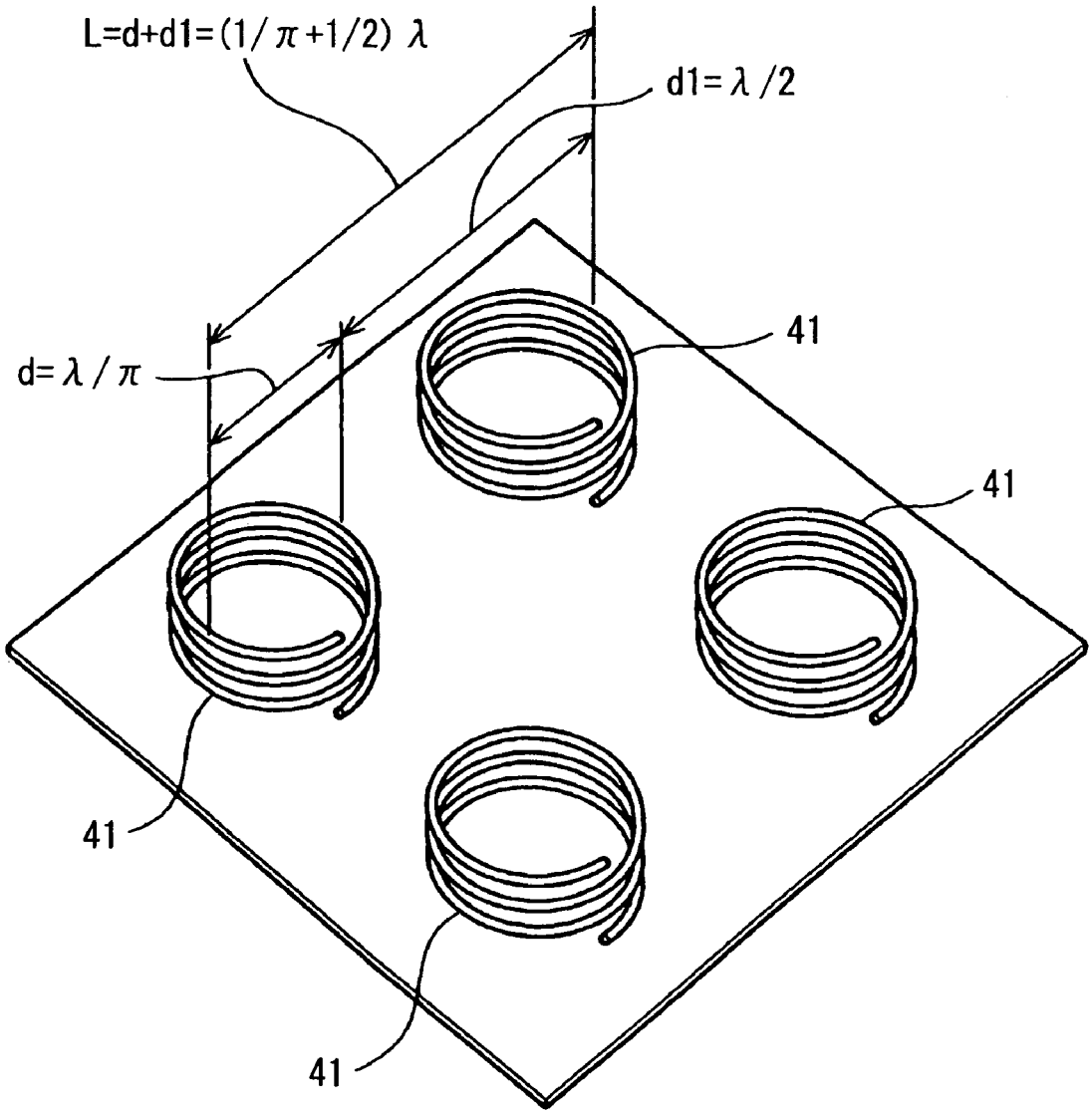
FIG. 15 RELATED ART
FIG. 15 is a perspective view illustrating an array of four helical antennas in accordance with a comparative example.

In the case of the present embodiment, a size of the antenna, i.e., a diameter D (see FIG. 1) of the second helical portion 12 having a larger diameter, is expressed as $D=2\lambda/\pi$, given that a wavelength of the oscillated high-frequency wave is $\lambda$. On the other hand, a comparative example shown in FIG. 15 illustrates an array of four helical antennas 41 in order to ensure directivity control at the same level as the present embodiment. In the case of the above comparative example, an outer diameter d of one helical antenna 41 is expressed as $d=\lambda/\pi$. The two adjacent helical antennas 41 need to be arranged at intervals of a distance $d1=\lambda/2$. As a result, at least an arrangement size $L=d+d1=(1/\pi+1/2)\lambda$ is required to arrange the array of four helical antennas 41. As described above, in the present embodiment, a required size for the arrangement of the second helical portion 12 having a largest diameter is D (FIG. 1), whereas in the comparative example, the arrangement size L is necessary to arrange the array of the antennas 41. Accordingly, the helical antenna 10 of the present embodiment is downsized compared to the comparative example, in which the helical antennas 41 are arrayed.

The above-described helical antenna 10 of the embodiment of the invention includes the first helical portion 11, whose one turn corresponds to one wavelength and the second helical portion 12, whose one turn corresponds to two wavelengths. The second helical portion 12 is located radially outward of the first helical portion 11. The antenna beam emitted from the first helical portion 11, and the antenna beam emitted from the second helical portion 12 have different phases and maximum gain directions from each other. For this reason, by changing the phase and intensity of the high-frequency power supplied to the first helical portion 11 and the second helical portion 12, the directivity of the main beam produced from the antenna beams changes. In the above-described manner, by disposing the first helical portion 11, whose one turn corresponds to one wavelength inward of the second helical portion 12, whose one turn corresponds to two wavelengths, the helical antenna 10 is made smaller in size compared to the conventional array of the antennas 41. Therefore, the directivity is arbitrarily controlled in a limited installation range without the helical antenna 10 growing in size. In addition, the Wilkinson divider is used for the divider 22 of the helical antenna 10 of the embodiment. Accordingly, the phase and intensity of the high-frequency electric power supplied to the first helical portion 11 and the second helical portion 12 are controlled using a simple structure.

Figure 6:
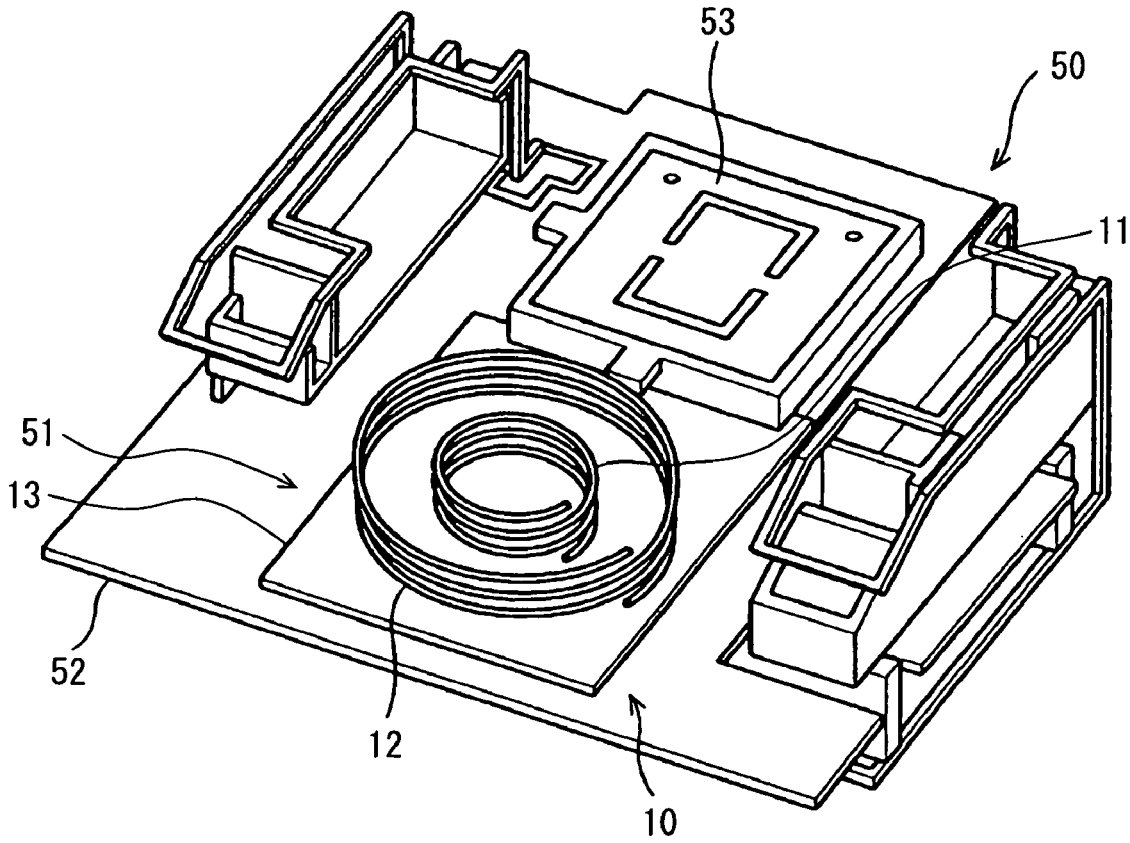
FIG. 6 is a perspective view illustrating an integrated antenna including the helical antenna in FIG. 1 as an electronic toll collection antenna.

Next, the in-vehicle antenna including the above-described helical antenna will be described below with reference to FIG. 6. An integrated in-vehicle antenna 50 includes the helical antenna 10 of the embodiment illustrated in FIG. 1 as an electronic toll collection (ETC) antenna 51. The integrated in-vehicle antenna 50 includes the ETC antenna 51 having the helical antenna 10, a casing 52, and a global positioning system (GPS)/vehicle information and communication system (VICS) antenna 53. The casing 52 accommodates the ETC antenna 51 and the GPS/VICS antenna 53. A case covering the ETC antenna 51 and the GPS/VICS antenna 53 which are accommodated in the casing 52, are not illustrated in a drawing. The GPS/VICS antenna 53 is a planar antenna. The GPS/VICS antenna 53 receives a radio wave transmitted from a GPS satellite, and receives a radio wave transmitted from a VICS beacon.

In the ETC antenna 51, an antenna beam needs to be directed at an elevation angle of 67 degrees, which is a direction of a radio on a road side. For this reason, an ETC antenna is mounted conventionally with an ETC antenna inclined by about 23 degrees with respect to a horizontal surface of a casing. On the other hand, in the case of the present embodiment, by using the above-described helical antenna 10 as the ETC antenna 51, the directivity of the main beam of the helical antenna 10 is controlled, as described above, by the phase and intensity of the high-frequency electric power supplied to the first helical portion 11 and the second helical portion 12. Thus, even if the helical antenna 10 is mounted in a horizontal manner, the main beam is set at a desired elevation angle of 67 degrees by controlling the phase and intensity of the high-frequency electric power supplied to the first helical portion 11 and the second helical portion 12. As a consequence, a required space for installation of the helical antenna 10 is reduced compared to the case in which the helical antenna 10 is inclined with respect to the horizontal surface. Therefore, the integrated in-vehicle antenna 50 is made smaller in size through the application of the helical antenna 10.

Moreover, the direction and directivity of the main beam emitted from the ETC antenna vary according to, for example, a type of a vehicle including the integrated in-vehicle antenna or an installation position of the in-vehicle antenna. This is because a structure of the in-vehicle antenna 50 and members installed in the vehicle vary with the types of vehicles, so that they influence the direction and directivity of the main beam. On the other hand, by using the helical antenna 10 of the present embodiment as the ETC antenna 51, the directivity of the main beam of the helical antenna 10 is controlled by the phase and intensity of the high-frequency electric power supplied to the first helical portion 11 and the second helical portion 12, as described above. Hence, the direction and directivity of the main beam are controlled for each type of the vehicle or installation position, without a design change of the helical antenna 10 and the integrated in-vehicle antenna 50. As a result, commonality of designs is achieved. Redesign for each type of vehicle becomes unnecessary, and fine adjustments of the directivity are easily made in accordance with a vehicle having the in-vehicle antenna 50.

A relationship between height and the number of turns of the second helical portion 12 will be described in detail below with reference to FIGS. 7A to 8. When the directivity is controlled to be the direction $\phi$ in the helical antenna 10 of the above-described embodiment, provided that the antenna beam 32 is at $\theta$=30 degrees, at which the directivity by the second helical portion 12 alone is maximized, the antenna beam 32 needs to be omni-directional in the direction $\phi$, i.e., to be even in the direction $\phi$, to maintain even gain in all directions. Characteristics of the gain of the second helical portion 12 in the direction $\phi$ correlate with the height and the number of turns of the second helical portion 12.

For this reason, a relationship between the height and the number of turns of the second helical portion 12 will be explained below.

When the height of the second helical portion 12 is 0.1$\lambda$ and the number of turns of the second helical portion 12 is one as illustrated in FIG. 7A, for example, the gain around $\phi$=30 degrees rapidly decreases. However, when the height of the second helical portion 12 is 0.1$\lambda$ and the number of turns of the second helical portion 12 is two to five, the gain is generally even throughout all directions in the direction $\phi$, so that the directivity approximate a circle. As well, provided that the height of the second helical portion 12 is 0.2$\lambda$ as illustrated in FIG. 7B, when the number of turns of the second helical portion 12 is one, the gain around $\phi$=30 degrees rapidly decreases. As opposed to this, when the height of the second helical portion 12 is 0.1$\lambda$ and the number of turns of the second helical portion 12 is two to five, the directivity of the gain is generally constant throughout all the directions in the direction $\phi$.

Provided that the height of the second helical portion 12 is 0.3$\lambda$, as illustrated in FIG. 7C, when the number of turns is one, the gain at $\phi$=30 degrees decreases and the gain increases at $\phi$=120 to 150 degrees. Accordingly, when the number of turns of the second helical portion 12 is one, the directivity of the gain in the direction $\phi$ has characteristics with an irregular shape which is far from a circle. Furthermore, when the number of turns is four and five, the gain decreases around $\phi$=120 degrees and the gain increases at $\phi$=0 to −90 degrees. Consequently, when the number of turns is four and five as well, the directivity of the gain of the second helical portion 12 in the direction $\phi$ has characteristics with an irregular shape which is far from a circle. Compared with this, when the number of turns is two and three, the gain of the second helical portion 12 has the directivity which approximates a comparatively regular circle throughout all the directions in the direction $\phi$. As illustrated in FIG. 7D, provided that the height of the second helical portion 12 is 0.4$\lambda$, when the number of turns is one, three, four and five, the gain in the direction $\phi$ has directivity with an irregular shape which is far from a circle. On the other hand, when the number of turns is two, the gain of the second helical portion 12 has the directivity which approximates a comparatively regular circle throughout all the directions in the direction $\phi$.

Figure 8:
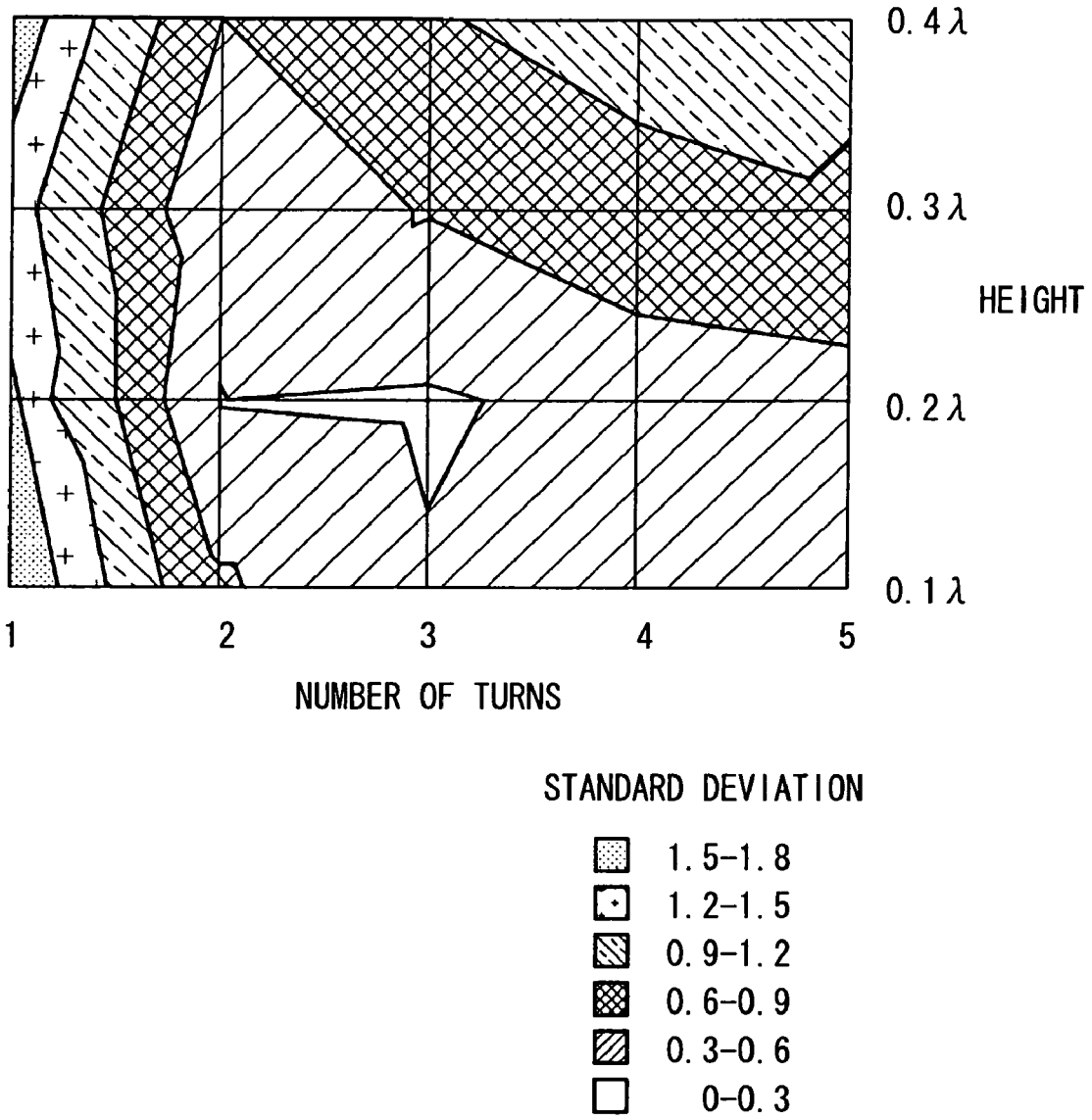
FIG. 8 is a diagram illustrating a relationship between the height and the number of turns of the second helical portion, and standard deviation of gain around $\phi$-axis in accordance with the embodiment.

By calculating the above-described variation in the directivity of the gain in the direction $\phi$ as standard deviation, a relationship between the number of turns and the height is illustrated in FIG. 8. In regard to the relationship between the height and the number of turns of the second helical portion 12, it is preferable that the directivity of the gain in the direction $\phi$ approximate a true circle. Accordingly, given that the number of turns is set with respect to the height of the second helical portion 12, the number of turns may be set such that the standard deviation indicating the directivity of the gain is equal to or smaller than 0.6 (i.e., standard deviation of gains of the respective directions is equal to or smaller than 0.6). If the standard deviation is equal to or smaller than 0.6, the directivity of the gain is close to a true circle, i.e., close to a constant value throughout all the directions in the direction $\phi$. As a result, by selecting the number of turns and the height, which result in the standard deviation being equal to or smaller than 0.6, the second helical portion 12 changes its directivity to the direction $\phi$ so that directivity of the helical portion 12 is controlled. In this case, as long as the standard deviation is equal to or smaller than 0.6, the number of turns of the second helical portion 12 is not limited to an integral value, and the second helical portion 12 may have any number of turns. When the height of the second helical portion 12 is set as described above, the height H of the second helical portion 12 may be set in a range of $0.1\lambda \leqq H \leqq 0.4\lambda$. This is because, given that the height H is $H<0.1\lambda$, the wire material, which is wound upward in a helical fashion, overlaps with each other, so that the helical antenna 10 does not function as an antenna. This is also because, given that the height H is $0.4\lambda<H$, the height of the wound wire material becomes excessive, so that the helical antenna 10 is of little practical use. In relation to the height H of the second helical portion 12, the number of turns of the second helical portion 12 may be set such that the directivity has a shape approximating a circle (standard deviation indicating the directivity by the second helical portion 12 is 0.6 or less). Accordingly, for example, at $\theta=30$ degrees where the directivity by the second helical portion 12 alone is maximized, the directivity becomes generally even and stabilized throughout all directions in the direction $\phi$. Therefore, by setting the number of turns of the second helical portion 12 in accordance with the height H thereof, the gain of the directivity controlled is stably enhanced in the direction $\phi$.

A relationship between gain and an eccentricity between the center of the first helical portion 11 and the center of the second helical portion 12, will be described below with reference to FIGS. 9 to 14. In the above-described embodiment, the first helical portion 11 whose one turn corresponds to one wavelength, and the second helical portion 12 whose one turn corresponds to two wavelengths are arranged in a generally concentric circle shape. Alternatively, the center of the first helical portion 11 may be displaced from the center of the second helical portion 12. In this manner, by disposing the centers of the first and second helical portions 11, 12 apart from each other, i.e., by arranging the first and second helical portions 11, 12 eccentrically to each other, the directivity of the main beam is changed. Therefore, the directivity of the main beam may be controlled more accurately by adjusting a positional relationship between the center of the first helical portion 11 and the center of the second helical portion 12, in addition to the phase and intensity of the high-frequency electric power supplied.

Figure 9:
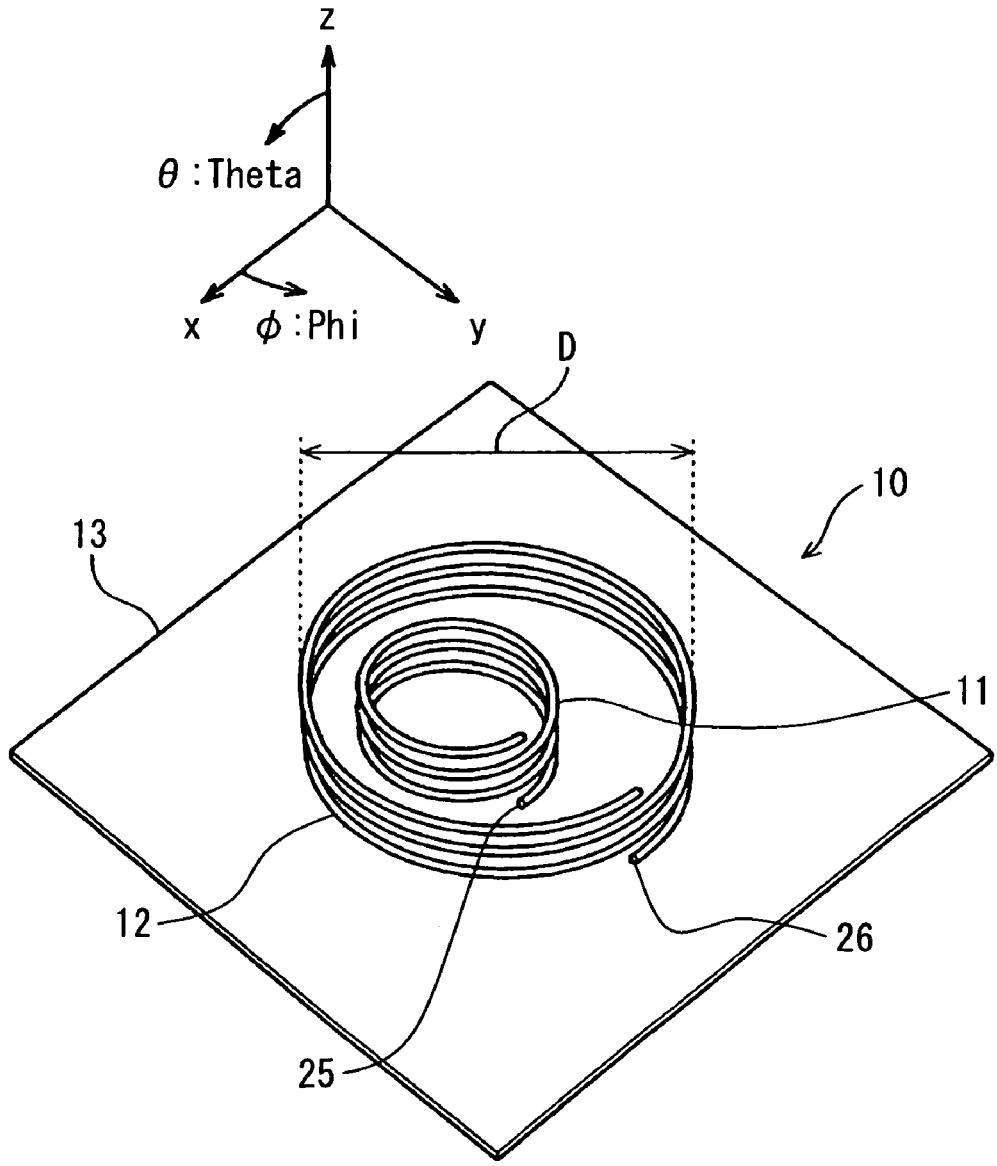
FIG. 9 is a diagram illustrating eccentric arrangement of the first helical portion and the second helical portion in accordance with the embodiment.
Figure 10:
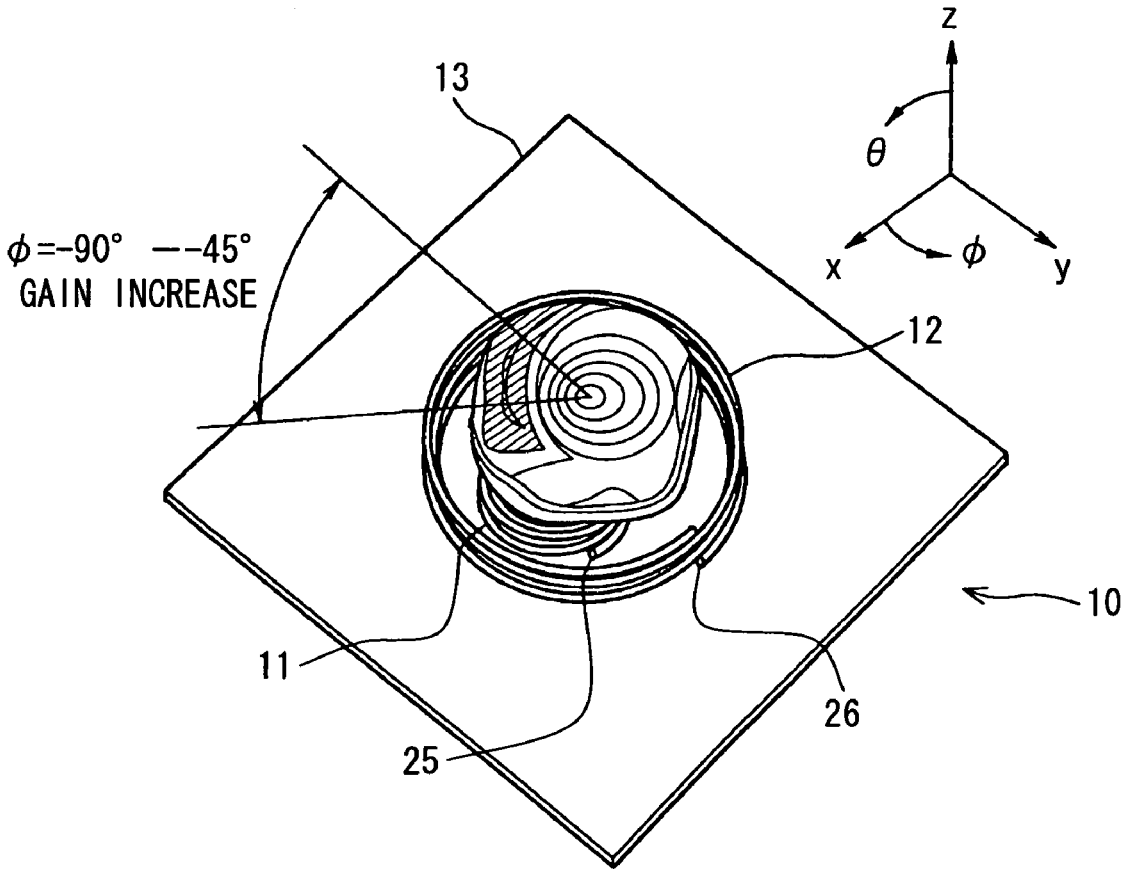
FIG. 10 is a diagram illustrating distribution of gain in structure of FIG. 9 in three dimensions.
Figure 11:
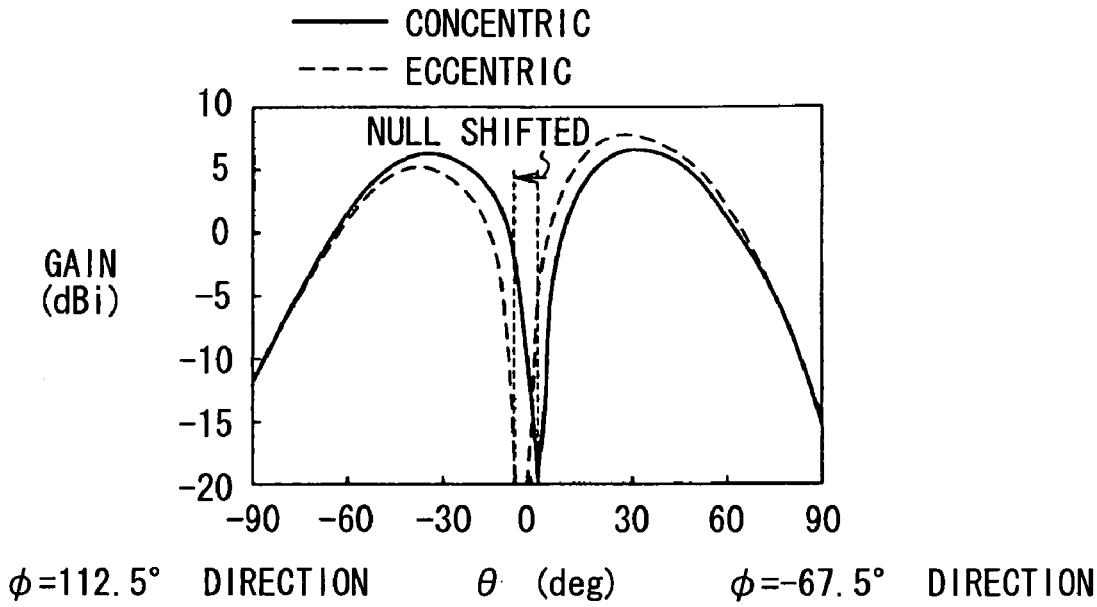
FIG. 11 is a diagram illustrating directivity in a direction $\theta$ at $\phi=-67.5$ degrees in the structure of FIG. 9.

When the center of the first helical portion 11 whose one turn corresponds to one wavelength, and the center of the second helical portion 12 whose one turn corresponds to two wavelengths are arranged eccentrically to each other, and then electric power is supplied to the second helical portion 12, as illustrated in FIG. 9, inductive coupling is generated at a portion ($\phi=0$) where the first and second helical portions 11, 12 come closest to each other. For this reason, due to a current flowing along the second helical portion 12, an induced current in opposite phase relative to the second helical portion 12 is generated in the first helical portion 11. One turn of the first helical portion 11 corresponds to one wavelength, and one turn of the second helical portion 12 corresponds to two wavelengths. Accordingly, in a range of $\phi=-90$ to $-45$ degrees, the current passing through the first helical portion 11 and the current passing through the second helical portion 12 flow in the same direction to reinforce each other. As a result, in regard to the directivity of the second helical portion 12, gain increases in the range of $\phi=-90$ to $-45$ degrees compared to when the first and second helical portions 11, 12 are concentrically arranged. In accordance with this, with regard to the directivity of the second helical portion 12, as shown in FIGS. 10 and 11, a sharp decreased portion (NULL) of gain which is generated in front of the ground plate 13, i.e., near $\theta=0$ degree, is shifted to $\phi=90$ to 135 degree side.

Figure 12:
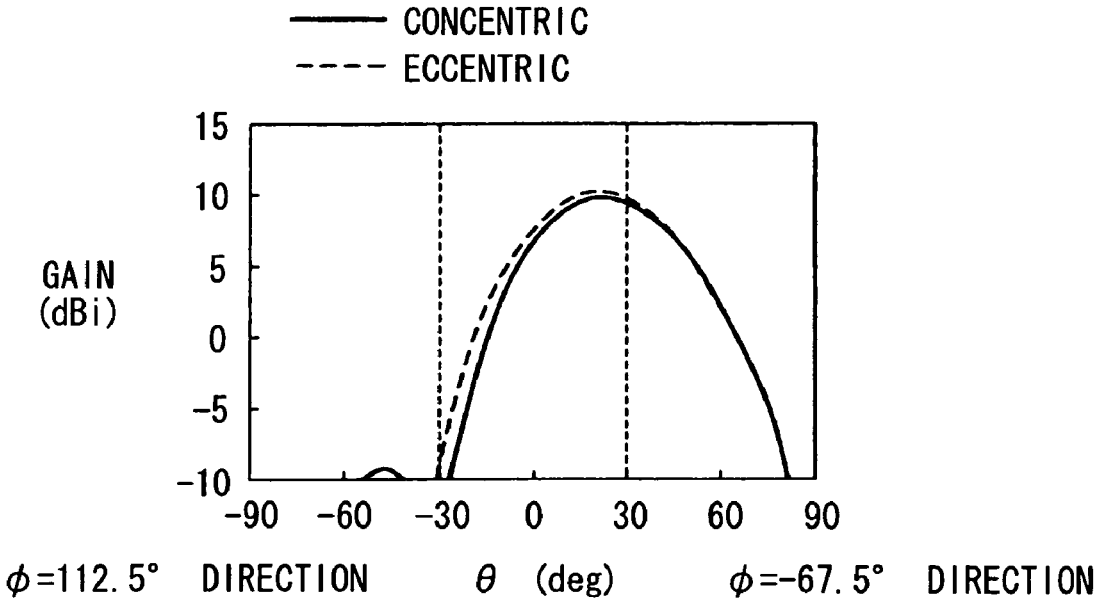
FIG. 12 is a diagram illustrating directivity in the direction $\theta$ in the structure of FIG. 9.
Figure 13:
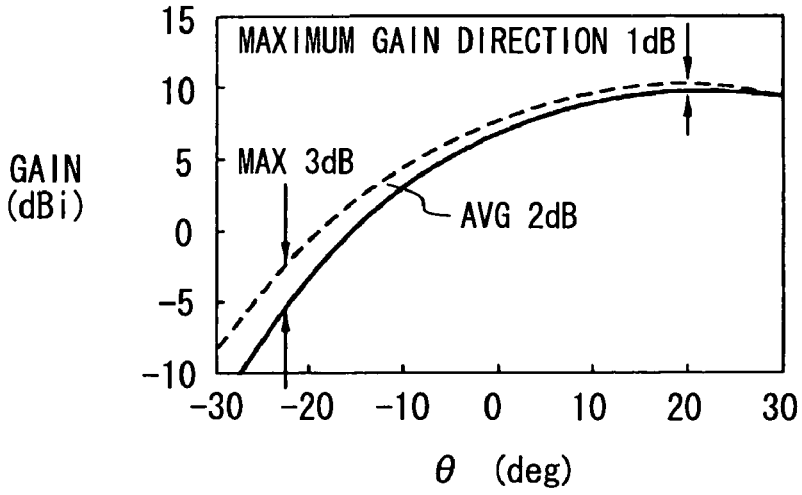
FIG. 13 is an enlarged view illustrating a range of $\theta=-30$ to 30 degrees in FIG. 12.

Directivities when electric power is supplied to the first and second helical portions 11, 12, are combined. In such a case, when the first helical portion 11 and the second helical portion 12 are made eccentric, as shown in FIGS. 12 and 13, maximum gain increases by about 1 dB compared to when they are not eccentrically arranged. Particularly, in a range of $\theta=-30$ to 30 degrees, i.e., near the front of the ground plate 13, gain increases by approximately 3 dB at a maximum and 2 dB on an average. Thus, by eccentrically arranging the first and second helical portions 11, 12, the maximum gain and the gain near the front of the ground plate 13 are adjusted.

Figure 14:
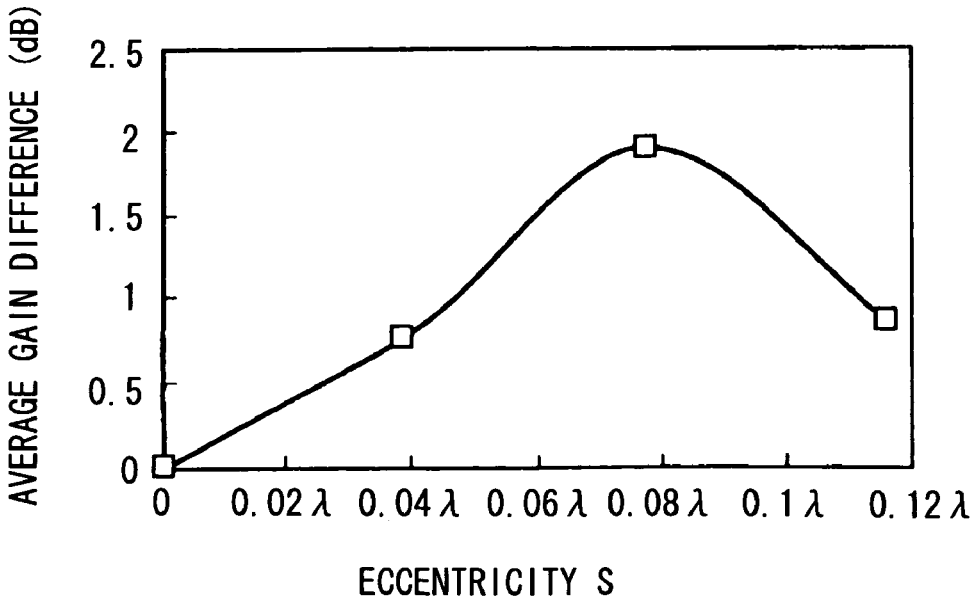
FIG. 14 is a diagram illustrating a relationship of an average gain difference with an eccentricity between the first helical portion and the second helical portion in accordance with the embodiment.

In FIG. 14, a "gain difference" means a difference between gain as a result of the composition of the directivities of the first and second helical portions 11, 12 when an eccentricity S of the first and second helical portions 11, 12 is 0 (zero), and gain as a result of the composition of the directivities of the first and second helical portions 11, 12 when they are made eccentric. An "average gain difference" is an average value of the gain differences in a range of 360 degrees with $\theta$-axis as the center. As shown in FIG. 14, the average gain difference varies with the eccentricity S, and when the eccentricity S reaches $0.04\lambda$ or larger, a partial gain difference becomes equal to or larger than 1 dB.

As described above, by adjusting the eccentricity S of the first and second helical portions 11, 12, the overall gain of the helical antenna 10 is adjusted without need for its entire redesign. Accordingly, when the helical antenna 10 is applied to more than one type of vehicle or more than one vehicle, influence of each vehicle or each vehicle type is reduced. The eccentricity S between the first and second helical portions 11, 12 may be set in a range of $0.04\lambda \leqq S \leqq 0.12\lambda$. The eccentricity S is set in a range of $S<0.04\lambda$ for the above-described reason. On the other hand, when the eccentricity S is in a range of $S>0.12\lambda$, the first helical portion 11 and the second helical portion 12, which is disposed outward of the first helical portion 11 come into contact with each other.

Modifications of the above embodiment will be described below. In the above embodiment, one turn of the first helical portion 11 corresponds to one wavelength, and one turn of the second helical portion 12 corresponds to two wavelengths. Moreover, each one turn of the first and second helical portions 11, 12 may correspond to any wavelength. Since the second helical portion 12 surrounds the first helical portion 11 radially outward thereof, given that one turn of the first helical portion 11 corresponds to N-wavelength and that one turn of the second helical portion 12 corresponds to M-wavelength, the relationship therebetween is expressed as $M>N$. In the above-described manner, by each one turn of the first and second helical portions 11, 12 corresponding to a wavelength in multiples of an arbitrary integer, in addition to the phase and intensity of the high-frequency electric power supplied, the directivity of the main beam may be controlled more accurately. Furthermore, one or more than one helical portion, such as a third helical portion, a fourth helical portion, . . . , and an Nth helical portion (N≧3), may be disposed radially outward of the second helical portion 12. Accordingly, the number of helical portions is not limited to two, and the helical antenna 10 may include three helical portions, or more than three helical portions. By combining more than one helical portion in this manner, the directivity may be controlled more accurately. In this manner, by arranging one or more than one helical portion radially outward of the second helical portion 12 in addition to the phase and intensity of the high-frequency electric power supplied, the directivity may be controlled more accurately.

The invention described above is not limited to the above embodiment, and may be applied to various embodiments without departing from the scope of the invention.

Additional advantages and modifications will readily occur to those skilled in the art. The invention in its broader terms is therefore not limited to the specific details, representative apparatus; and illustrative examples shown and described.

What is claimed is:

1. A helical antenna comprising:

a ground plate;

a first helical portion that is wound in a spiral manner generally perpendicular to a plane of the ground plate;

a second helical portion that is wound in a spiral manner generally perpendicular to the plane of the ground plate and surrounds the first helical portion on a radially outer side of the first helical portion; and a feeder circuit including:

an oscillator;

a divider connected to the oscillator;

a first phase shifter connected between a first output terminal of the divider and a feeding point of the first helical portion; and a second phase shifter connected between a second output terminal of the divider and a feeding point of the second helical portion, wherein:

a length of one turn of the first helical portion is equal to a result of multiplication of a wavelength of oscillation of the oscillator by a first predetermined number;

a length of one turn of the second helical portion is equal to a result of multiplication of the wavelength by a second predetermined number; and the second predetermined number is larger than the first predetermined number.

2. The helical antenna according to claim 1, wherein the divider is a Wilkinson divider.

3. The helical antenna according to claim 1, wherein the first predetermined number is one, and the second predetermined number is two.

4. The helical antenna according to claim 1, further comprising a third or further helical portion, which is wound in a spiral manner generally perpendicular to the plane of the ground plate, on a radially outer side of the second helical portion.

5. The helical antenna according to claim 1, wherein an axial height of the second helical portion and a number of turns of the second helical portion are correlationally set in such a manner that a standard deviation of directivity of the second helical portion is equal to or smaller than 0.6, so that the directivity is formed in a shape that approximates a circle.

6. An in-vehicle antenna comprising the helical antenna of claim 1.

7. A helical antenna comprising:

a ground plate;

a first helical portion that is wound in a spiral manner generally perpendicular to a plane of the ground plate;

a second helical portion that is wound in a spiral manner generally perpendicular to the plane of the ground plate and surrounds the first helical portion on a radially outer side of the first helical portion; and a feeder circuit including:

an oscillator;

a divider connected to the oscillator;

a first phase shifter connected between a first output terminal of the divider and a feeding point of the first helical portion; and a second phase shifter connected between a second output terminal of the divider and a feeding point of the second helical portion, wherein:

a length of one turn of the first helical portion is equal to a result of multiplication of a wavelength of oscillation of the oscillator by a first predetermined number;

a length of one turn of the second helical portion is equal to a result of multiplication of the wavelength by a second predetermined number;

the second predetermined number is larger than the first predetermined number; and the first helical portion and the second helical portion are eccentrically arranged with centers of the first and second helical portions away from each other by 0.04λ or larger, given that λ is a wavelength of a high-frequency wave of the oscillation of the oscillator.

* * * * *